US007960632B2

(12) United States Patent
Izen et al.

(10) Patent No.: US 7,960,632 B2
(45) Date of Patent: Jun. 14, 2011

(54) DRUM KITS AND METHODS AND APPARATUS FOR CONNECTING COMPONENTS OF DRUM KITS

(75) Inventors: Mark Izen, Chestnut Hill, MA (US); Suzanne Wasserman, Winchester, MA (US); Andrea Gaiter, Sudbury, MA (US); David Yiu, Tin Shui Wai (HK)

(73) Assignee: First Act Inc., Boston, MA (US)

( * ) Notice: Subject to any disclaimer, the term of this patent is extended or adjusted under 35 U.S.C. 154(b) by 0 days.

(21) Appl. No.: 12/618,307

(22) Filed: Nov. 13, 2009

(65) Prior Publication Data

US 2011/0113948 A1 May 19, 2011

(51) Int. Cl.
*G10D 13/02* (2006.01)

(52) U.S. Cl. ..... 84/411 R

(58) Field of Classification Search ..... 84/411 R, 84/421, 420

See application file for complete search history.

(56) References Cited

U.S. PATENT DOCUMENTS

| | | | | |
|---|---|---|---|---|
| 4,185,808 | A * | 1/1980 | Donohoe et al. | 248/295.11 |
| 4,930,548 | A | 6/1990 | Turek et al. | |
| 5,845,898 | A | 12/1998 | Halder et al. | |
| 6,477,746 | B1 | 11/2002 | Axelsson | |
| 6,755,103 | B2 | 6/2004 | Morehead | |
| 7,051,635 | B2 | 5/2006 | Morehead | |
| 7,296,534 | B2 | 11/2007 | Fink | |

* cited by examiner

*Primary Examiner* — Kimberly R Lockett

(74) *Attorney, Agent, or Firm* — Wolf, Greenfield & Sacks, P.C.

(57) ABSTRACT

Drum kits and connector assemblies for connecting components of drum kits are described. Some of the described connector assemblies are configured to provide one or more pre-defined acceptable interconnection orientations. Some of the described connector assemblies facilitate easy interconnection and disconnection of components of a drum kit. Described interconnection types include snap connections and locking interconnections, among others.

20 Claims, 10 Drawing Sheets

DRUM KITS AND METHODS AND APPARATUS FOR CONNECTING COMPONENTS OF DRUM KITS

BACKGROUND

1. Field

The present application is directed to drum kits and apparatus and methods for connecting components of drum kits.

2. Discussion of Related Art

It is conventional to interconnect certain drums of a drum kit. Typically, the bass drum serves as one of the drums being interconnected, with other drums mounted on the bass drum. Often, a snare drum, tom drum, and/or cymbal will be mounted on the bass drum.

The conventional mounting hardware for connecting the snare drum, tom drum, and/or cymbal to the bass drum includes a female receptacle mounted to each of the drums being interconnected, and an L-arm. The L-arm, which has a circular cross-section, has two mating ends, each one of which slides into a cavity of a female receptacle mounted to one of the drums being interconnected, with the cavities likewise having circular cross-sections to engage the L-arm. Making use of the circular nature of the L-arm and the female receptacle cavities, the user then rotates the L-arm within the cavity to position the drums being interconnected in a desired orientation relative to each other. A wing nut is then threaded into a hole in the surface of the female receptacle transverse to the cavity and tightened against an outer surface of the L-arm.

SUMMARY

Aspects of the present invention are directed to drum kits and apparatus and methods for connecting components of drum kits.

According to one aspect of the present invention, a drum kit comprises a first kit component, the first kit component being a first drum, a second kit component, the second kit component being a second drum or a cymbal, and a connector assembly interconnecting the first drum and the second kit component. The connector assembly may be configured to interconnect the second kit component to the first drum in a discrete, non-rotatable orientation relative to first drum.

According to another aspect of the present invention, a drum kit comprises a first component, the first component being a first drum, a second component, and a connector assembly. The connector assembly comprises a lock configured to lock the second component into place relative to the first drum.

According to another aspect of the present invention, a drum kit comprises a first kit component comprising a first drum, a second kit component, and a connector assembly comprising at least first and second connection components arranged to mate in a mating relationship and thereby secure the second kit component to the first kit component. The connector assembly comprises at least one resilient component adapted to bias the first and second connection components into the mating relationship and configured to snap the first drum into a fixed orientation relative to the second kit component.

Other aspects and features of the present invention will be apparent from the following description and figures.

BRIEF DESCRIPTION OF DRAWINGS

In describing various embodiments of the present invention, reference will be made to the following figures. It should be appreciated that the figures are not all necessarily drawn to scale. Items appearing in multiple figures are identified with the same reference number in each of the figures in which they appear. For purposes of clarity, not every item may be labeled in every figure.

DETAILED DESCRIPTION

Figure 1:
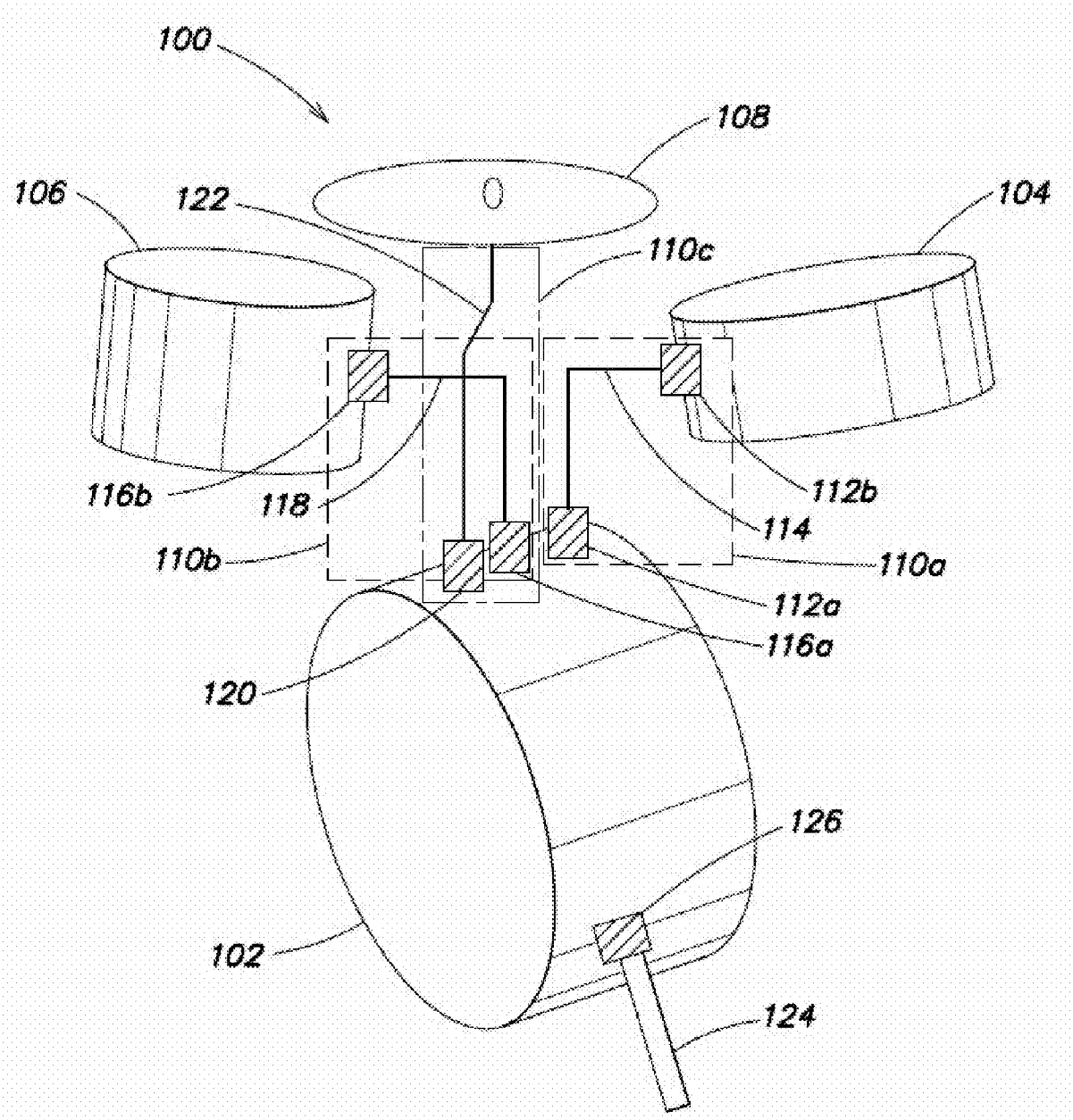
FIG. 1 illustrates a drum kit according to one embodiment of the present invention, illustrating the interconnection of components of the drum kit using a non-limiting example of a connector assembly as described herein.

Applicants have appreciated that the conventional hardware described above in the Background section for interconnecting drums of a drum kit allows for the drums being interconnected to rotate relative to each other, and does not restrict the relative orientations of the drums. This ability to rotate the drums allows for fine tuning of the relative drum orientations, which may be viewed positively by some users, such as experienced users with established preferences. However, Applicants have appreciated that the variable nature of the conventional interconnection hardware adds to the complexity of interconnecting the drums for some users, for example young children or novice drummers who, for example, may not have established drum orientation preferences and may not be certain of how the drums should be positioned relative to each other. Applicants have appreciated that such users may benefit from connection assemblies that restrict the allowable relative orientations of the drums being interconnected, for example so that the user may quickly and easily identify a proper interconnection orientation.

In addition, Applicants have appreciated that the conventional mounting hardware, requiring threading of a wing nut against a cylindrically shaped surface, may involve unnecessary assembly effort and complexity for at least some users, which may, for example, lead to unsatisfactory interconnection (e.g., not tightening the wing nut sufficiently to provide stable positioning), frustration, and a negative experience for the user. Applicants have appreciated that connection assemblies having easy-to-use locking interconnection mechanisms and/or snap-fit interconnection mechanisms may be preferable for some users.

According to one aspect of the present invention, drum kits include connector assemblies providing for one or more pre-defined, discrete interconnection orientations for components (e.g., drums) of the drum kits. The rotation of interconnected drum kit components relative to each other allowed by conventional interconnection hardware may be restricted or eliminated, which may in some embodiments simplify interconnection of the drum kit components, for example for young children and novice drummers.

According to some aspects of the present invention, drum kits include connector assemblies that allow for easy, fast, and secure interconnection of components (e.g., drums). According to one such aspect, a connector assembly may comprise one or more locks that securely interconnect components (e.g., two drums, a drum and a cymbal, etc.) of a drum kit. As will be understood from the following discussion and figures, a lock is a device that provides a secure engagement that cannot be overcome by substantially any amount of force short of breaking the lock, other than by operating a release mechanism of the lock. According to some aspects described herein, the locks of connector assemblies connecting components of a drum kit may be engaged and released easily and quickly by control of a resilient component (e.g., a spring) of the lock. In such a manner, easy interconnection of drum kit components may be facilitated in some embodiments. As will be described further below, one embodiment of a lock of a connector assembly for connecting components of a drum kit provides a ball lock connection.

According to a further aspect of the invention, a drum kit may comprise a connector assembly for connecting components of the drum kit that comprises a snap-fit connection mechanism. In this manner, components of the drum kit may be snapped into an interconnecting relationship, and in some such embodiments may be released from the interconnecting relationship by apply a sufficiently strong force to overcome the snap-fit connection. In at least one such embodiment, the connector assembly may comprise a resilient component (e.g., a spring) that may be operated easily and quickly by a user, and which may bias two components of the connector assembly into a mating relationship. One non-limiting example of a snap-fit interconnection according to an embodiment of the present invention is a ball-detent interconnection, as will be described further below.

Various aspects of the invention are now described in turn. These aspects can be used singly, or, to the extent they are not mutually exclusive, all together or in any combination of two or more.

FIG. 1 illustrates a drum kit 100 according to one non-limiting embodiment of the present invention. As will be described, various of the components of the drum kit may be interconnected using connector assemblies that provide for interconnection of components in pre-defined, non-rotatable orientations relative to each other. Also, the connector assemblies may include a lock providing secure interconnection of the components and having a resilient component that may be operated by a user to engage and disengage the lock. In some embodiments, the connector assemblies may additionally or alternatively include a snap-fit mechanism.

The drum kit 100 comprises a bass drum 102 interconnected with a snare drum 104, a tom drum 106 (also referred to herein simply as a "tom"), and a cymbal 108. The interconnection between the bass drum 102 and the snare drum 104 is formed by a connector assembly 110*a*. The interconnection between the bass drum and the tom is formed by a connector assembly 110*b*. The interconnection between the bass drum and the cymbal is formed by a connector assembly 110*c*. In addition, the drum kit comprises a bass drum spur 124 mounted to the bass drum 102 by a female receptacle (also referred to herein as a "mount") 126. A second bass drum spur may be positioned on the opposite side of the bass drum from the bass drum spur 124 to stabilize the bass drum, and therefore is not visible in the perspective of FIG. 1. As will be explained further below, in some embodiments the female receptacle 126 may be similar or substantially the same as any of the female receptacles of one or more of the connector assemblies described herein, and may function in a similar or the same manner. According to one embodiment, the bass drum spur and female receptacle 126 may be configured to interconnect in a similar or the same manner as any of the connector assemblies described herein.

One or more of connector assemblies 110*a*, 110*b*, and 110*c* may be configured to substantially prevent rotation of the interconnected components relative to each other, may comprise a lock to lock the components into place relative to each other, and/or may comprise a snap-fit connection mechanism. As an example, connector assembly 110*a* comprises a first female receptacle (or "mount") 112*a* mounted to a shell of the bass drum 102 and a second female receptacle 112*b* mounted to a shell of the snare drum 104, into which opposing ends of an L-arm 114 are inserted. The L-arm and female receptacle 112*a* may be arranged to allow for proper engagement of the two only in one or more pre-defined, non-rotatable orientations. For example, the cross-section of the L-arm 114 may be sized and shaped to fit into an opening of a cavity of the female receptacle 112*a* in one or more pre-defined orientations. As a non-limiting example, the cavity of the female receptacle 112*a* may have a square-shaped opening and the end of the L-arm 114 to be inserted into the cavity may similarly have a square cross-section, such that the L-arm may be inserted into the cavity in four possible orientations. The square cross-sections/shapes may also prevent rotation of the L-arm 114 once inserted into the female receptacle 112*a*, and thus it should be appreciated that in this manner the ultimate orientation of the snare drum 104 relative to the bass drum 102 may be limited. According to one embodiment, the L-arm and female receptacle may be configured to allow for mating of the two only in two or fewer pre-defined, non-rotatable orientations. Other numbers of pre-defined, non-rotatable orientations may be provided in other embodiments, as the various aspects described herein relating to providing pre-defined, non-rotatable mating orientations are not limited to any particular number unless otherwise specified.

Other manners than that just described may alternatively be used to limit the acceptable mating orientations of the L-arm 114 and the female receptacle 112*a*, as that manner just described is merely one non-limiting example. For example, other cross-sectional shapes (other than square) of the L-arm and/or the shape of the cavity of the female receptacle may be used, alignment notches and/or slots on the L-arm and/or within the female receptacle may be used, or any other suitable shape and/or feature that prevents relative rotation may be used. In addition, any number (including one or more) of discrete, non-rotatable mating orientations may be provided, as the various aspects of the invention described herein relating to providing discrete, non-rotatable mating orientations are not limited to any particular number of orientations.

The female receptacle 112*b* mounted to the shell of the snare drum 104 may be configured and arranged to engage with an end of the L-arm 114 in a manner similar to that just described with respect to female receptacle 112*a*. Thus, according to one embodiment, the L-arm 114 may be configured to mate with the female receptacle 112*b* in one of one or more pre-defined, non-rotatable orientations, which may be achieved in any of the manners described above or in any other suitable manner.

In the non-limiting example of FIG. 1, the connector assembly 110*a* includes an L-arm which is formed of two portions, which, for purposes of simplicity, may be referred to herein as a "horizontal" portion and a "vertical" portion, although it should be appreciated they need not be oriented at a right angle relative to each other. In one embodiment, it may be desirable to limit the orientation of the snare drum 104 relative to the bass drum 102 about only one of these portions of the L-arm, for example the vertical portion inserted into the female receptacle 112*a*. In such an embodiment, the L-arm 114 and female receptacle 112*a* may be arranged and configured to allow for mating of the L-arm 114 and the female receptacle 112*a* only in one or more pre-defined, non-rotatable orientations, while the L-arm 114 and female receptacle 112*b* may not be so limited, but rather may be arranged and configured to allow for rotation of the L-arm 114 with respect to the female receptacle 112*b*. In an alternative embodiment, it may be desirable to limit rotation with respect to both portions of the L-arm 114, in which case the L-arm 114, female receptacle 112*a* and female receptacle 112*b* may be arranged and configured to allow for the L-arm 114 to be inserted into both the female receptacle 112*a* and the female receptacle 112*b* in pre-defined, non-rotatable orientations. Thus, in some embodiments, the female receptacles 112*a* and 112*b* may be substantially identical, although not all embodiments are limited to having identical connection mechanisms on both sides of an L-arm.

Also, while component 114 is described herein as being an "L-arm," as are components 118 and 122, it should be appreciated that any suitable connecting arms may be used, and that L-arms represent only one suitable, non-limiting example.

The connector assembly 110*b* interconnecting the bass drum 102 and the tom 106 may be similar or substantially identical to the connector assembly 110*a*, although not all embodiments are limited in this respect. In the illustrated embodiment, the connector assembly 110*b* comprises a first female receptacle 116*a* mounted to the shell of the bass drum 102 and a second female receptacle 116*b* mounted to a shell of the tom 106. An L-arm 118 is configured to engage with the first female receptacle 116*a* and the second female receptacle 116*b*, thus interconnecting the bass drum with the tom. The L-arm 118 and the female receptacle 116*a* may be arranged and configured to allow for proper engagement of the two only in one or more pre-defined, non-rotatable orientations, for example in the manner described above in connection with L-arm 114 and female receptacle 112*a*, or in any other suitable manner. Likewise, the L-arm 118 and female receptacle 116*b* may be arranged and configured to allow for proper engagement of the two only in one or more pre-defined, non-rotatable orientations. However, not all embodiments are limited to preventing rotation of the L-arm 118 with respect to both the female receptacle 116*a* and the female receptacle 116*b*.

The connector assembly 110*c* interconnecting the bass drum 102 and the cymbal 108 may comprise a female receptacle 120 and a connecting arm 122, which may be arranged and configured such that the connecting arm 122 may properly engage with the female receptacle 120 in one of one or more pre-defined acceptable orientations. For example, the female receptacle 120 may be similar or substantially identical to any of the female receptacles described thus far, and the connecting arm 122 may have a cross-section, alignment notch, alignment groove, or any other design feature limiting its potential engagement orientations with the female receptacle 120, for example as described above in connection with L-arm 114. The connecting arm 122 may be connected to the cymbal 108 in any suitable manner, such as by a washer and wing nut, as the various aspects of the invention are not limited in this respect.

According to one embodiment, the female receptacle 126 and bass drum spur 124 are configured to interconnect in one or more predefined, non-rotatable orientations, for example, similar to the interconnection of female receptacle 112*a* and L-arm 114, or in any other suitable manner. The female receptacle 126 and bass drum spur 124 may form a locked interconnection, similar to that described below with respect to connector assembly 200 and/or a snap interconnection similar to that described below. Other manners of connection of female receptacle 126 and bass drum spur 124 are also possible.

Examples of the connector assemblies of drum kit 100 are now given with respect to the following figures.

Figure 2A:
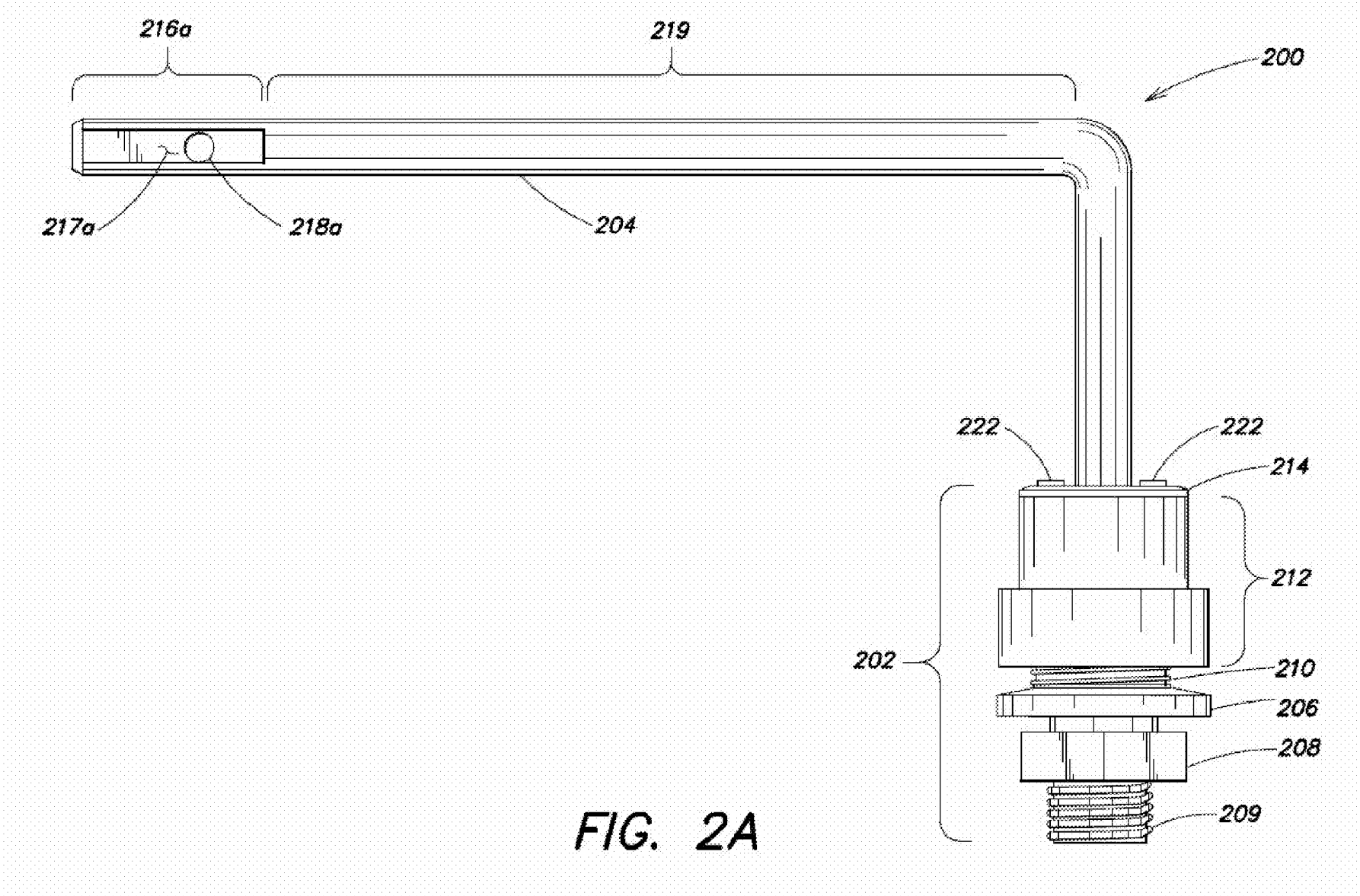
FIG. 2A illustrates a non-limiting example of a connector assembly comprising a lock and configured to be mounted to a component of a drum kit, according to one non-limiting embodiment of the present invention.

FIG. 2A illustrates a non-limiting example of a connector assembly 200 which may be used in connection with the drum kit 100, for example as one or more of the connector assemblies 110*a*, 110*b*, and/or 110*c*. In this non-limiting example, the connector assembly 200 forms a releasable lock (formed by the combination of the female receptacle 202 and the L-arm 204) having a resilient component that may be actuated by a user to engage and release the lock. As will be understood from the following description and figures, in this non-limiting example the releasable lock forms a ball lock connection, although other types of locking connections may alternatively be used, as those aspects of the invention relating to drum kit component connector assemblies comprising locks are not limited to the lock(s) utilizing any particular type of locking connection. In addition, the connector assembly 200 is configured to interconnect components of a drum kit (e.g., two drums of a drum kit) in one or more pre-defined, non-rotatable orientations, as will be understood from the following description.

As illustrated in FIG. 2A, the connector assembly 200 comprises female receptacle 202 and L-arm 204, which in FIG. 2A is fully engaged with the female receptacle 202 in a locked relationship, as will be further understood by reference to the subsequent figures. The female receptacle 202 is configured to be mounted to (or "affixed to") a first component of a drum kit (e.g., to the shell of a drum, such as bass drum 102), and comprises a base mount 206 and a nut 208. The base mount 206 has a lower portion, illustrated as threaded portion 209, that is configured to be inserted into an opening of the drum kit component (e.g., a bass drum) to which it is to be mounted, and the nut 208 is threaded onto the threaded portion to fasten the base mount 206 in place. For example, the base mount 206 may be positioned substantially on an outer surface of the shell of bass drum 102 and the nut 208 may be threaded onto threaded portion 209 of the base mount 206 on an inner surface of the shell of bass drum 102, thus securing the base mount to the shell of the bass drum 102.

The base mount further comprises a cavity (visible in FIG. 2B as item 220, but not shown in FIG. 2A) configured to engage an end of the L-arm 204, as shown. The engagement operation of the female receptacle 202 may be controlled at least partially by resilient component 210 (illustrated as a coil spring, but not so limited), sleeve 212, and top cover 214. The sleeve 212 may be configured concentrically about part of the base mount 206, as will be shown and described in greater detail below, and may be movable with respect thereto. In some embodiments, such as that of FIGS. 2A and 2B, the sleeve may be configured concentrically about the cavity of female receptacle 202 which engages the L-arm 204. The coil spring 210, which, again, may be any suitable resilient component, may bias the sleeve 212 against the top cover 214, which itself may be fastened to the base mount 206 in a fixed position, for example by screws 222 or any other fastening mechanism (glue, soldering, clips, etc.). Thus, the sleeve 212 may be movable between a first position in which it contacts the top cover 214, when the coil spring is expanded, and a second position in which it contacts a portion of the base mount 206, when the coil spring is compressed. Moving the sleeve 212 between these two positions may allow for insertion/removal of the L-arm to/from the cavity of the female receptacle 202 and locking of the L-arm in the cavity, as will be further described with respect to the subsequent figures. In the non-limiting example of FIG. 2A, the L-arm may be locked into the female receptacle 202 when the coil spring is expanded, biasing the sleeve against the top cover, and may be free to be inserted into or removed from the female receptacle 202 when the coil spring is compressed.

As shown, the L-arm 204 comprises a first end 216*a* having a non-circular cross-section comprising the flattened surface 217*a*, and a detent 218*a* formed therein. The cross-section may be square, hexagonal, octagonal, or have any other suitable shape, one example of which is shown in FIG. 2C. The non-circular cross-section may be configured to engage with a similarly or different shaped cavity (e.g., item 220 in FIG. 2D) of a female receptacle, similar to female receptacle 202, mounted to a second component of a drum kit to prevent rotation of the L-arm with respect to the female receptacle. The detent 218*a* may be configured to receive a movable locking member, such as a ball (e.g., a stainless steel ball ("SUS" ball) 226*a*, although any suitable material and/or shape may be used), to lock the L-arm into the female receptacle. The portion 219 of the L-arm 204 may have a substantially circular cross-section, or any other suitable shape, as the various aspects described herein are not limited in this respect. Although not visible in the view of FIG. 2A, in some embodiments the end 216*a* of the L-arm may have a second flattened surface similar to flattened surface 217*a* and, for example, opposite flattened surface 217*a*, having a detent formed therein similar to detent 218*a*.

Figure 2B:
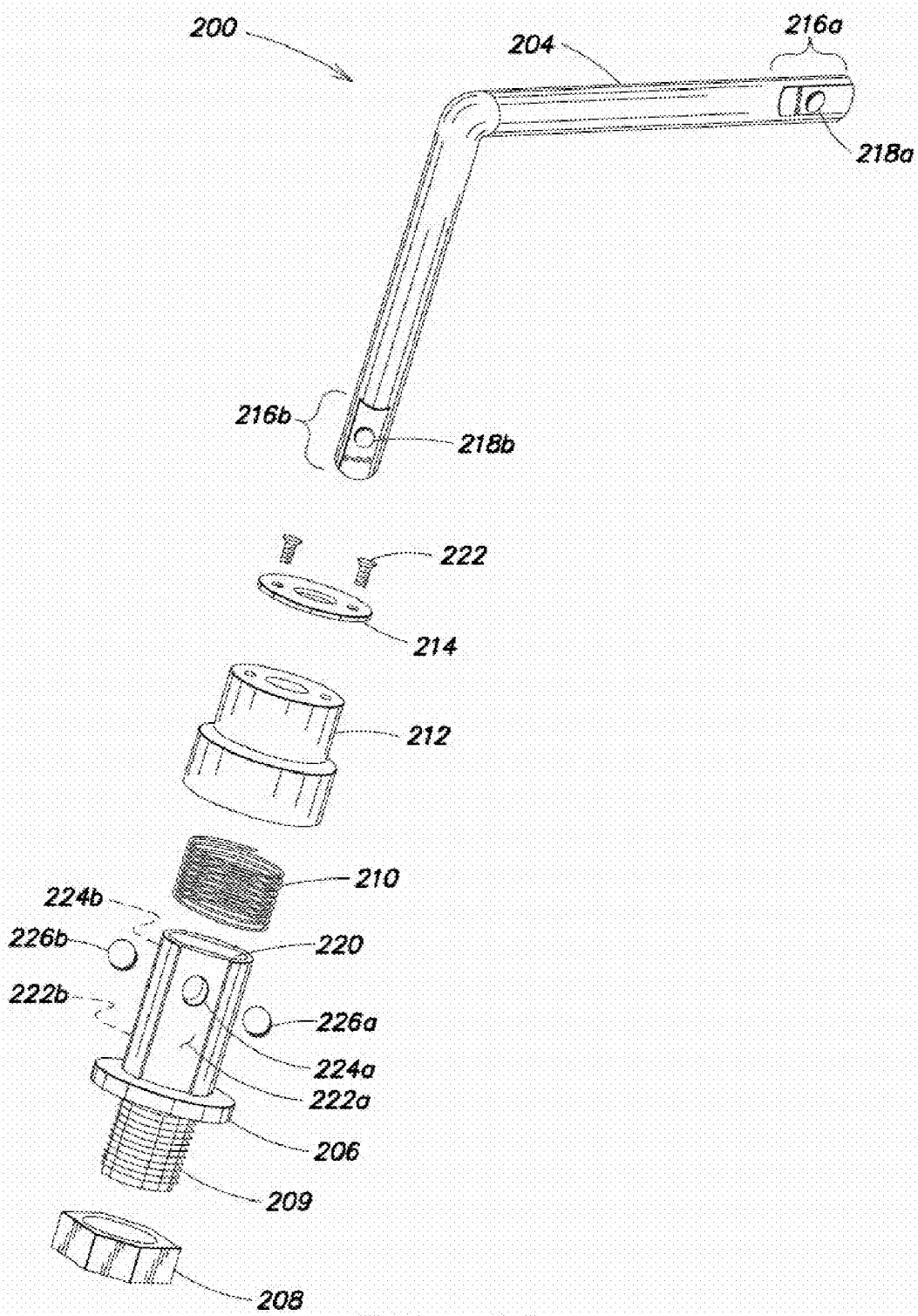
FIG. 2B is an exploded view of the connector assembly of FIG. 2A.
Figure 2C:
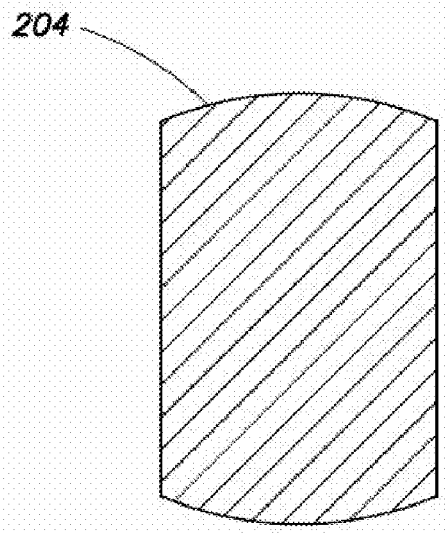
FIG. 2C illustrates one non-limiting example of a cross-sectional shape of an end of the L-arm of FIGS. 2A and 2B.

The second end 216*b* of the L-arm 204, which is not visible in FIG. 2A since it is inside the female receptacle 202, but which is shown in FIG. 2B, may be similarly shaped to the first end 216*a*, and may similarly have one or more detents 218*b* therein configured to receive one or more locking members, as will be described in greater detail below. It should be appreciated that the specific components of connector assembly 200 illustrated in FIG. 2A are not limiting, and that various other components and configurations may be used to form a connector assembly according to aspects of the invention described herein.

Figure 2D:
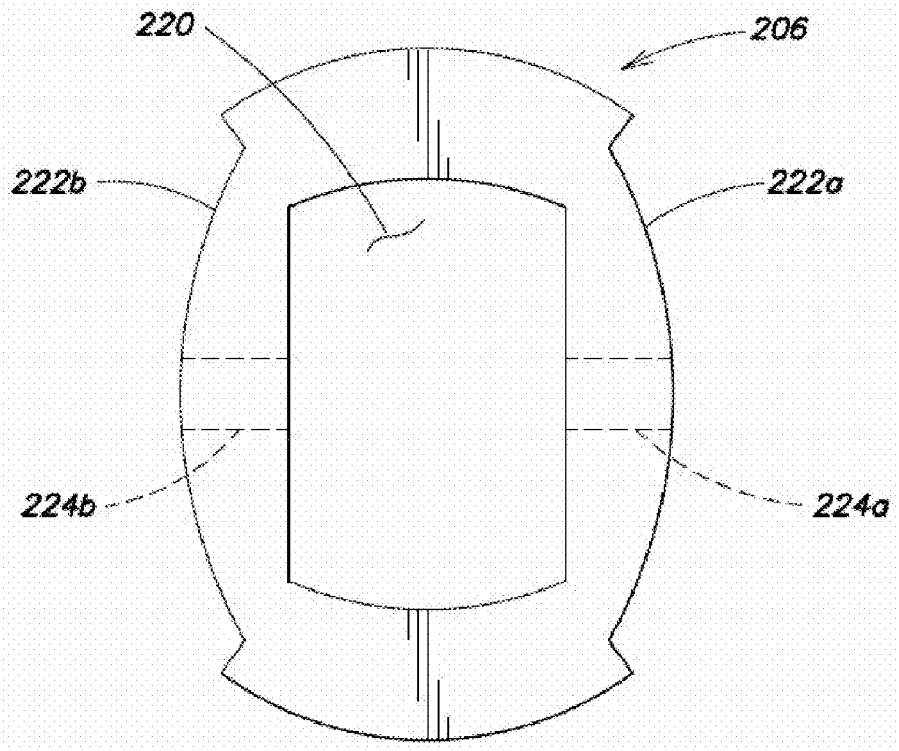
FIG. 2D illustrates one non-limiting example of a top view of an end of the base mount 206 of FIGS. 2A and 2B, illustrating an example of the shape of an opening of the cavity of the base mount.

FIG. 2B illustrates an exploded view of the connector assembly 200 of FIG. 2A. As shown, the base mount 206 comprises a cavity 220 having an opening with a cross-section configured to receive the second end 216*b* of the L-arm 204 in a pre-defined, non-rotatable orientation. An example of the cross-sectional shape of an end of the L-arm (e.g., end 216*b*) is shown in FIG. 2C, and an example of the shape of the opening of cavity 220 is shown in FIG. 2D, which illustrates a top view of the base mount 206. The openings 224*a* and 224*b*, described further below, are illustrated in phantom in FIG. 2D to show their relative placement. It should be appreciated that the cross-sectional shape in FIG. 2C may be substantially the same as the shape of the opening of cavity 220 in FIG. 2D, allowing for engagement of the L-arm and female receptacle when the shapes are suitably aligned.

The coil spring 210 may be configured to fit concentrically about an outer surface of the base mount 206, and in some embodiments the coil spring 210 may be configured concentrically about the cavity 220. The sleeve 212 may be positioned concentrically outside the coil spring 210 and at least a portion of the base mount 206, and therefore in some embodiments may also be oriented concentrically with respect to the cavity 220. The top cover 214 may be secured to the base mount 206 in a fixed position by any suitable mechanism, for example, by screws 222, or in any other suitable manner. Thus, the top cover may serve as a fixed stop point beyond which the sleeve cannot move.

As shown in FIG. 2B, the base mount 206 comprises a groove 222*a*, an opening 224*a*, and a SUS ball 226*a*. The SUS ball 226*a* may be disposed within the opening 224*a*, and may be capable of travelling within the opening 224*a* into and out of the cavity 220, as will be further described with respect to the subsequent figures. The SUS ball represents one non-limiting example of a movable locking member, although other locking members may be used in other embodiments, including spring-loaded locking members, and the various aspects described herein are not limited to using any particular type of locking member. Although not visible in FIG. 2B, it should be appreciated that the base mount may have a second groove 222*b*, a second opening 224*b*, and the second SUS ball 226*b*, which may be arranged in combination similarly to the corresponding components 222*a*, 224*a*, and 226*a*, on an opposing side of the base mount 206. The groove 222*b* and opening 224*b* are visible in FIG. 2D.

Figure 3B:
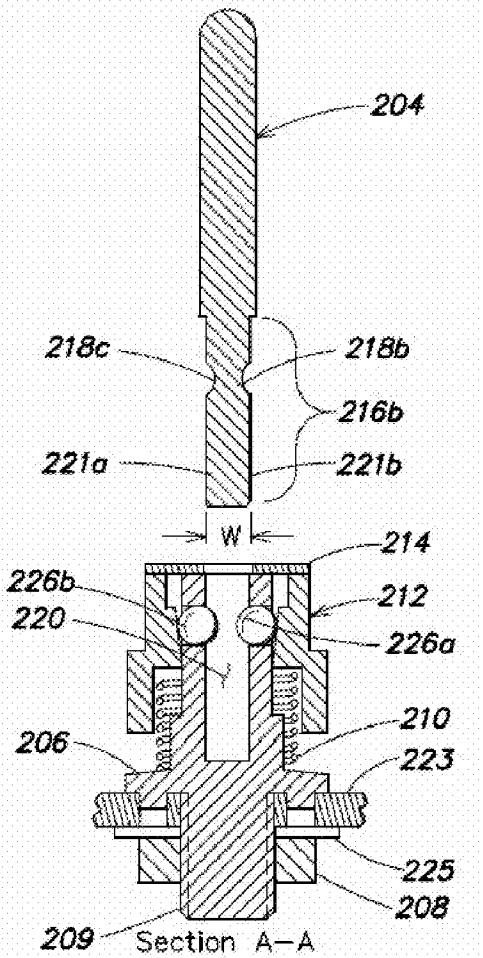
FIGS. 3A and 3B illustrate an outer view and a cross-sectional view, respectively, of the connector assembly of FIG. 2A in a disengaged state.
Figure 3A:
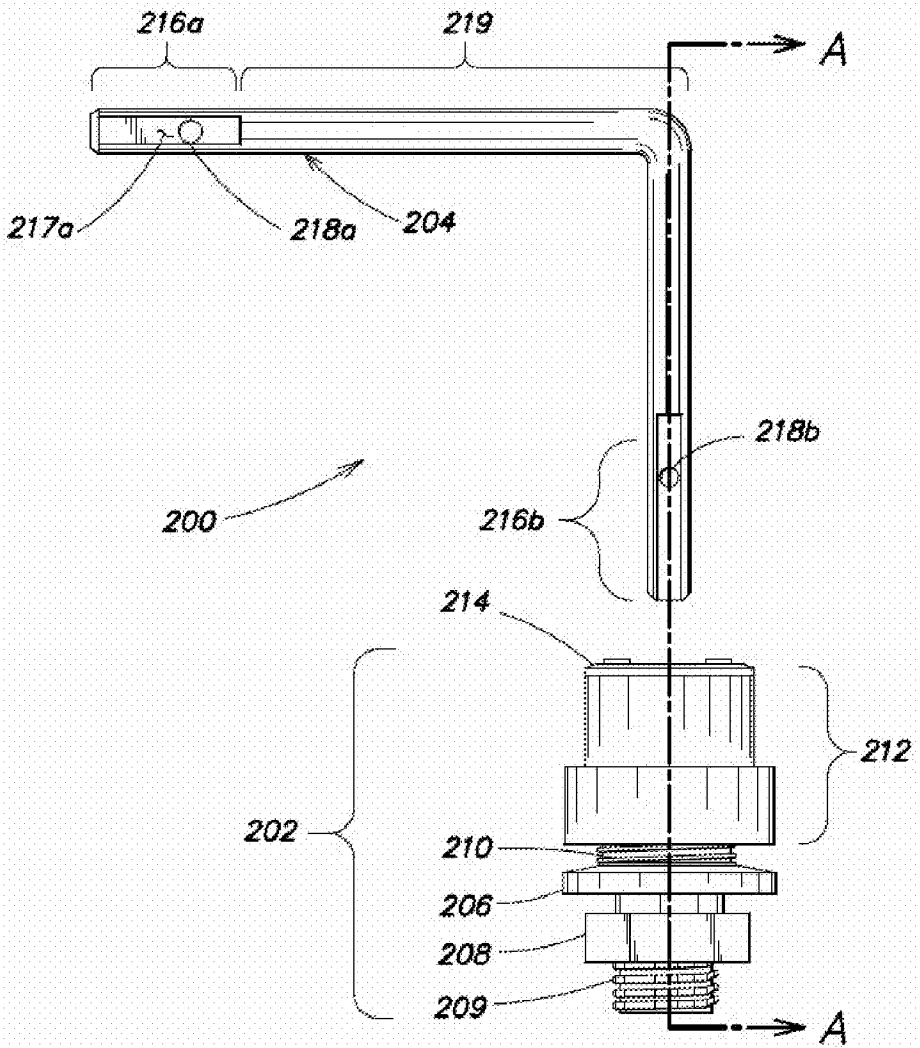

The operation of the connector assembly 200 will now be described with respect to FIGS. 3A-7B. FIGS. 3A and 3B illustrate an outer view and a cross-sectional view, respectively, of the connector assembly 200 in a disengaged state. The cross-section illustrated in FIG. 3B is taken along the line A-A of FIG. 3A. FIG. 3B differs slightly from FIG. 3A in that it additionally shows a portion 223 of a drum kit component (e.g., a shell of a bass drum) to which the base mount 206 may be mounted. An optional washer 225 may also be included.

As shown in FIG. 3B, the end 216*b* of the L-arm 204 has two flattened surfaces, 221*a* and 221*b*. Surface 221*a* has a detent 218*c* formed therein and surface 221*b* has the detent 218*b* formed therein. The detents 218*b* and 218*c* may be configured to receive the SUS balls 226*a* and 226*b*, respectively, as will be described further below. In doing so, the L-arm may be locked into the female receptacle 202.

As shown in FIG. 3B, the inner surface of the sleeve 212 is shaped to provide a variable constraint on the motion of SUS balls 226*a* and 226*b* depending on the vertical positioning of the sleeve, and therefore on the amount of compression of the coil spring 210. In the state of FIG. 3B, the sleeve 212 is biased against the top cover 214 by the coil spring 210, such that the inner surface of sleeve 212 contacts the SUS balls 226*a* and 226*b* in a manner that prevents the SUS balls from being displaced sufficiently from the cavity 220 to allow the end 216*b* of the L-arm 204 to move past the SUS balls. In other words, if one were to try and insert the end 216*b* into the cavity 220 with the sleeve positioned as shown in FIG. 3B, the end 216*b* would not fit past the SUS balls 226*a* and 226*b* because the inner surface of the sleeve 212 prevents the SUS balls from moving outwardly sufficiently to accommodate the width W of the end 216*b* in the cavity 220.

Figure 4B:
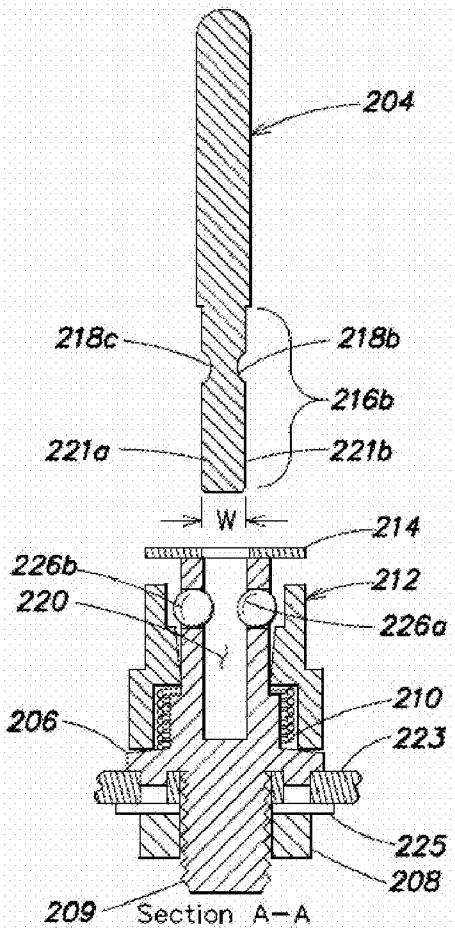
FIGS. 4A and 4B illustrate an outer view and a cross-sectional view, respectively, of the connector assembly of FIG. 2A in which the sleeve is depressed in preparation for receiving the L-arm.
Figure 4A:
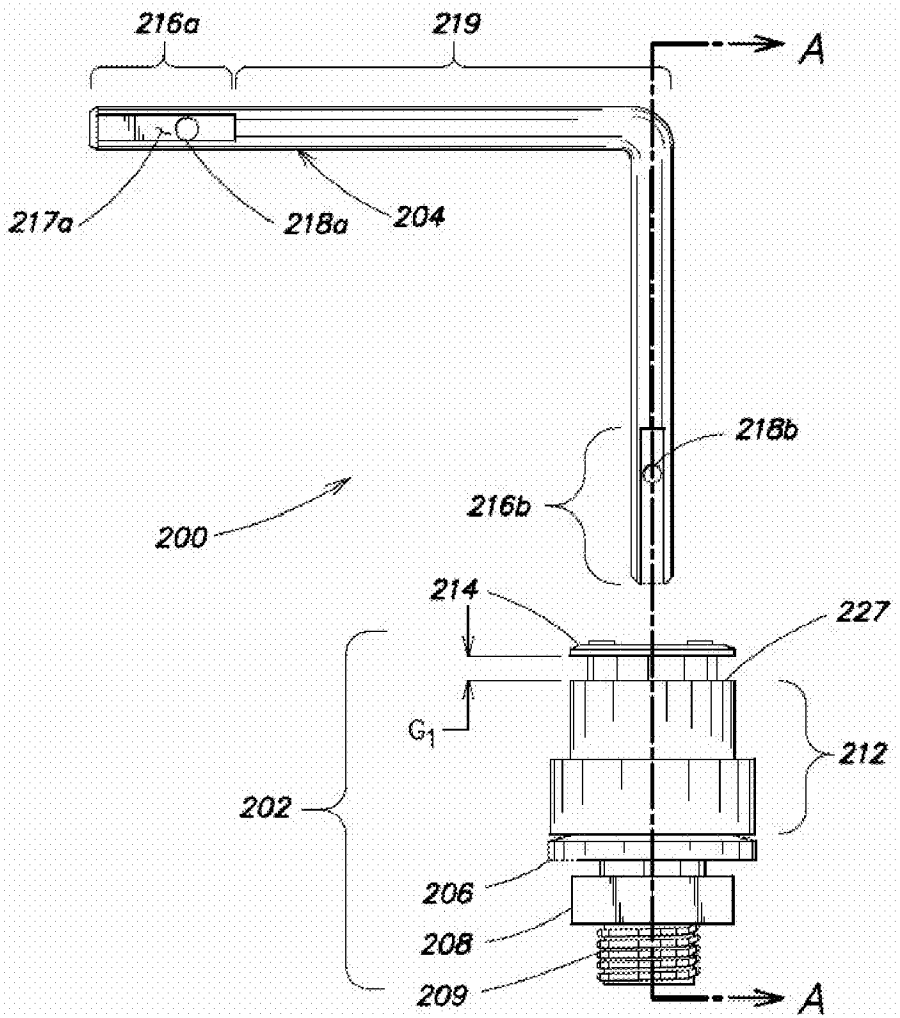

FIGS. 4A and 4B illustrate an outside view and a cross-sectional view, respectively, of the connector assembly 200 in a state in which the sleeve 212 is moved downwardly to compress the coil spring 210, thus altering the constraint on the outward motion of SUS balls 226*a* and 226*b* and allowing for the L-arm to be inserted into or removed from the cavity 220. As shown, the inner surface of the sleeve 212 flares outwardly such that when the sleeve is positioned as shown in FIGS. 4A and 4B the SUS balls 226*a* and 226*b* are free to travel sufficiently outwardly through the openings 224*a* and 224*b* that the gap between the SUS balls may accommodate the width W of the end 216*b* of the L-arm. In this particular non-limiting embodiment, the SUS balls 226*a* and 226*b* are not biased either inwardly toward the cavity or outwardly against the inner surface of the sleeve 212, but may be forced outwardly in any suitable manner, for example by inserting the end 216*b* into the cavity 220. In this embodiment, a gap $G_1$ is present between the top cover 214 and an upper surface 227 of the sleeve 212, although not all embodiments are limited in this respect.

Figure 5B:
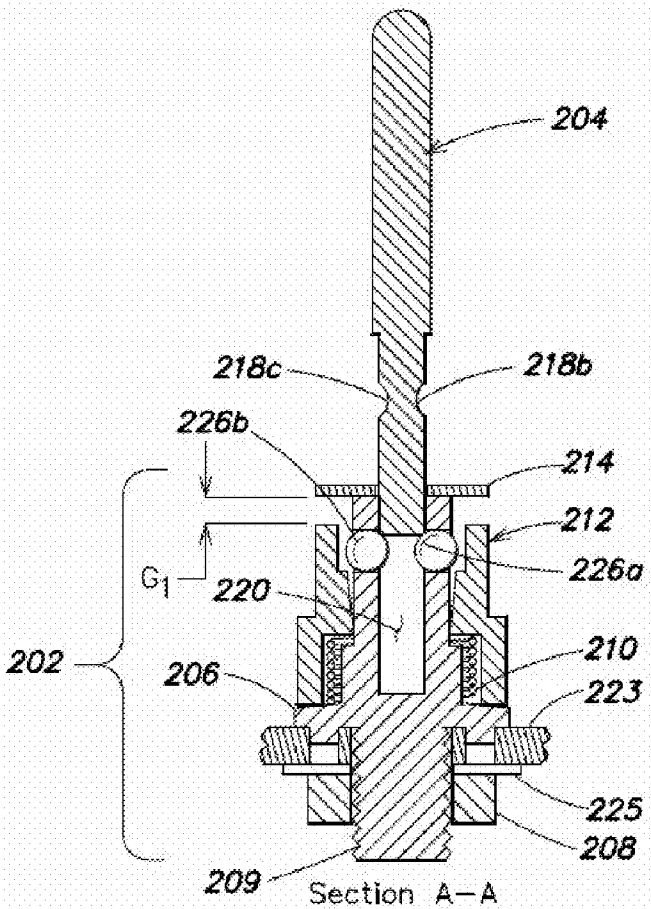
FIGS. 5A and 5B illustrate an outer view and a cross-sectional view, respectively, of the connector assembly of FIG. 2A in which the L-arm is partially inserted into a receiving cavity.
Figure 5A:
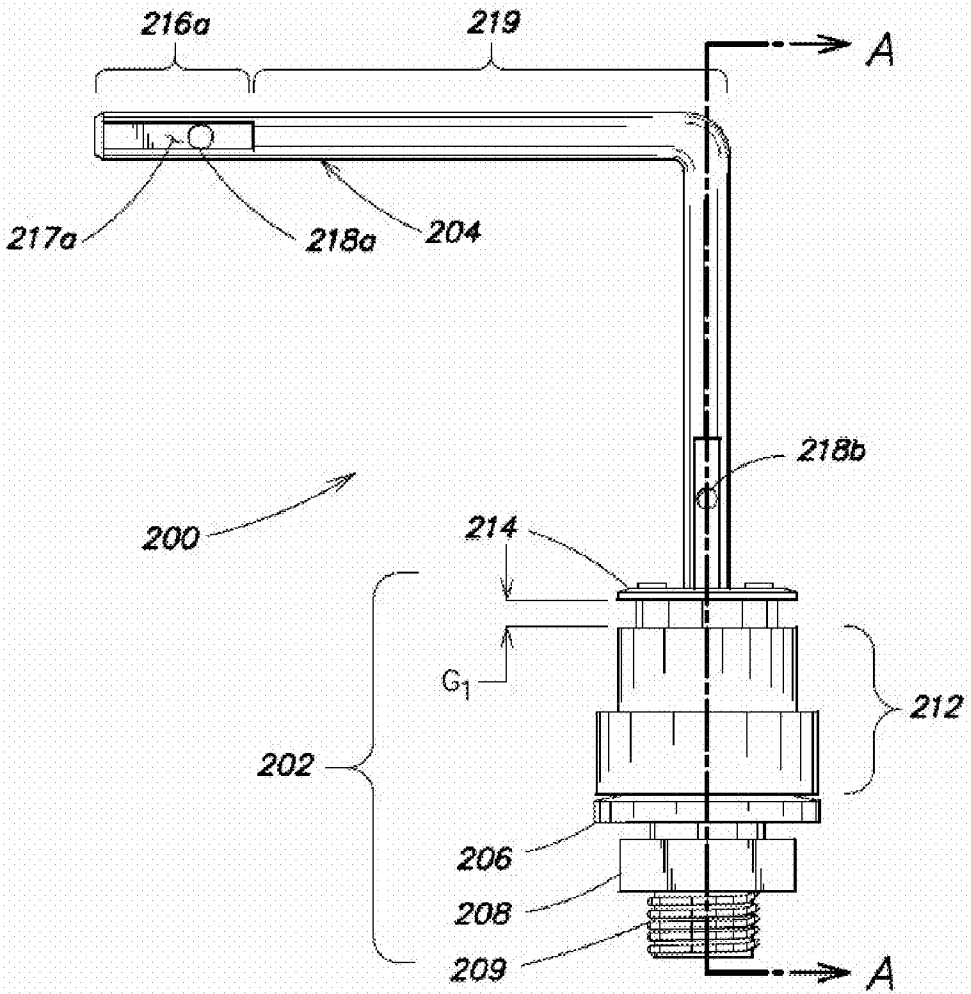

FIGS. 5A and 5B illustrate an outside view and a cross-sectional view, respectively, of the connector assembly in a state in which the L-arm 204 is partially inserted into the cavity 220. As shown, in this state, female receptacle is substantially the same as in FIG. 4B, i.e., the sleeve 212 remains in a downward position as the coil spring 210 is compressed, such that the gap $G_1$ between the top cover 214 and the upper surface 227 of the sleeve is present, and the SUS balls 226*a* and 226*b* are free to move outwardly from the cavity 220 against the inner surface of the sleeve 212 to a sufficient degree to accommodate the width W of the end 216*b* between them. Inserting the end 216*b* into the cavity, as shown, forces the SUS balls outwardly in this non-limiting embodiment.

Figure 6B:
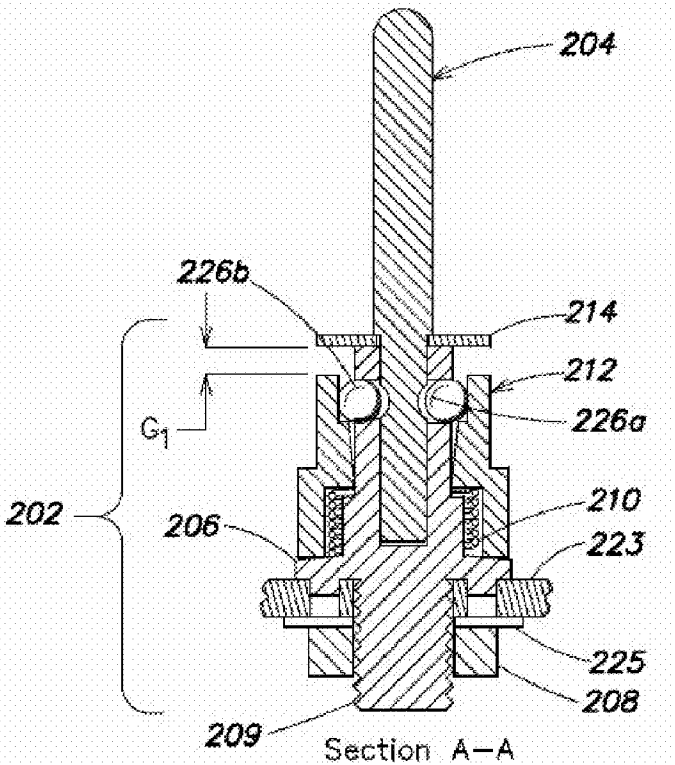
FIGS. 6A and 6B illustrate an outer view and a cross-sectional view, respectively, of the connector assembly of FIG. 2A in which the L-arm is fully inserted into the receiving cavity.
Figure 6A:
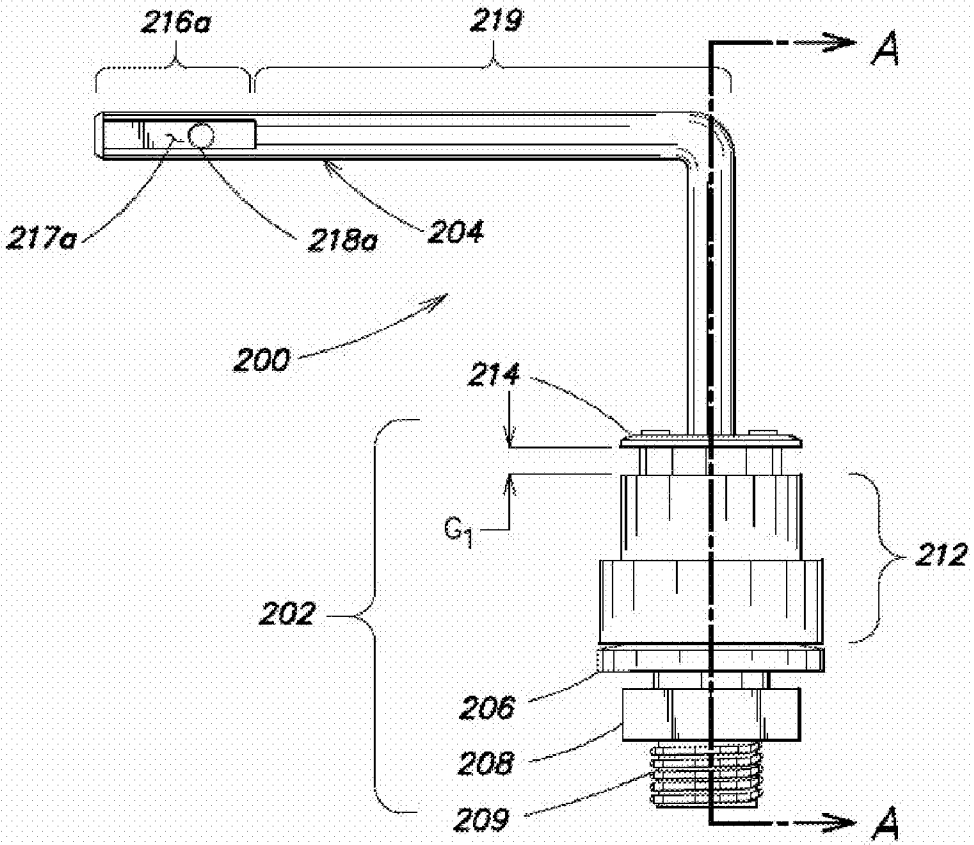

FIGS. 6A and 6B show an outside view and a cross-sectional view, respectively, of the connector assembly 200 with the L-arm fully inserted into the cavity 220. In the illustrated state, the coil spring 210 is compressed. The SUS balls 226*a* and 226*b* align with the detents 218*b* and 218*c*, respectively. In this state, with the sleeve down against the base mount 206, the L-arm is not locked into place, but rather may be removed from the cavity 220 by applying a sufficient force, since the SUS balls 226*a* and 226*b* are still capable of being moved outwardly from the cavity in this state.

Figure 7B:
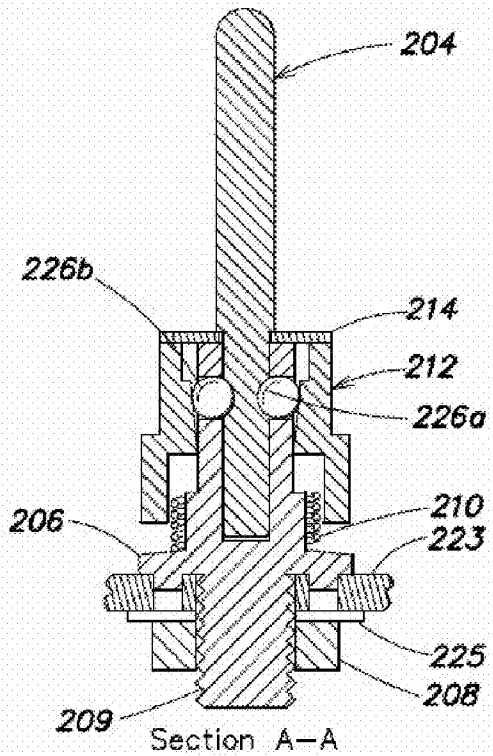
FIGS. 7A and 7B illustrate an outer view and a cross-sectional view, respectively, of the connector assembly of FIG. 2A in which the L-arm is fully inserted into the receiving cavity in a locked state.
Figure 7A:
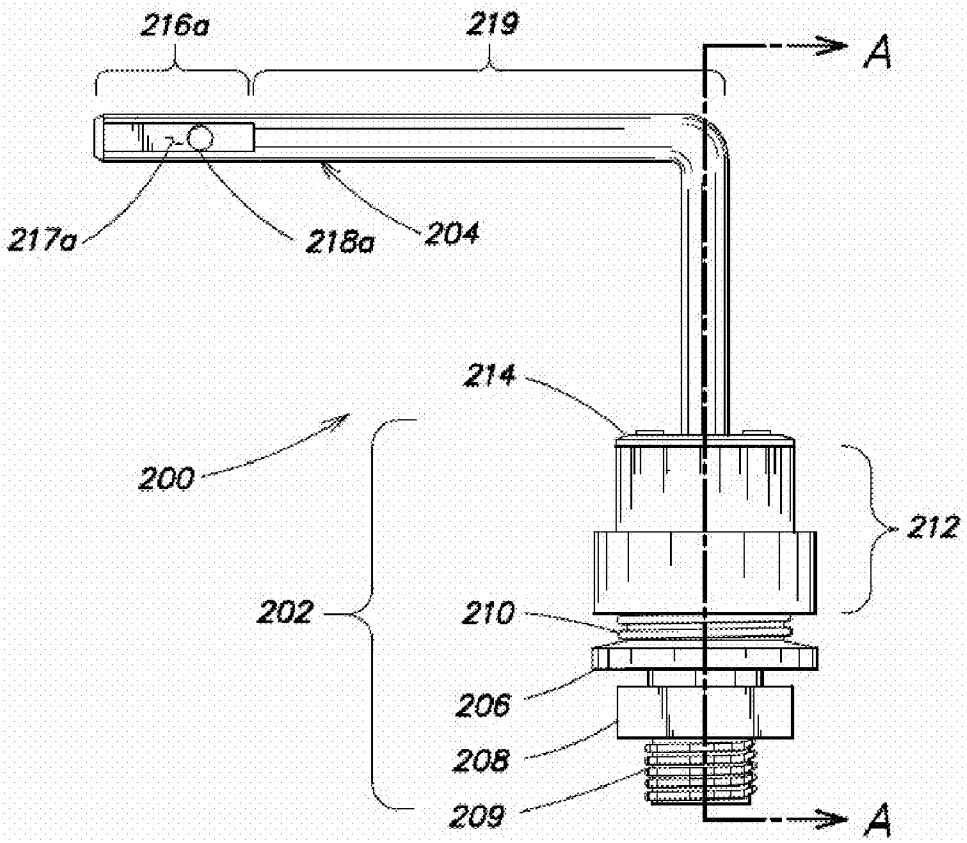

FIGS. 7A and 7B illustrate an outside view and a cross-sectional view, respectively, of the connector assembly 200 in a locked state. In this state, the sleeve 212 is biased against the top cover by the coil spring 210, such that the inner surface of the sleeve 212 contacting the SUS balls 226*a* and 226*b* constrains the SUS balls such that the spacing between them is less than the width W of the end 216*b*. Thus, the L-arm 204 is securely engaged with the female receptacle 202. The L-arm may be removed by releasing the lock, i.e., by displacing the sleeve downward and then removing the L-arm.

It should be appreciated that the non-limiting example of FIGS. 2A-7B are provided primarily for purposes of illustration, and that various alternatives are possible. For example, a resilient component other than a coil spring may be used to bias the sleeve, and may be arranged in any relative position with respect to the other components of the female receptacle. The coil spring is merely one non-limiting example of a resilient component. Similarly, the SUS balls 226*a* and 226*b* are non-limiting examples of movable locking members. Other locking members may be used, and need not be spherically shaped or have any particular shape.

Figure 8A:
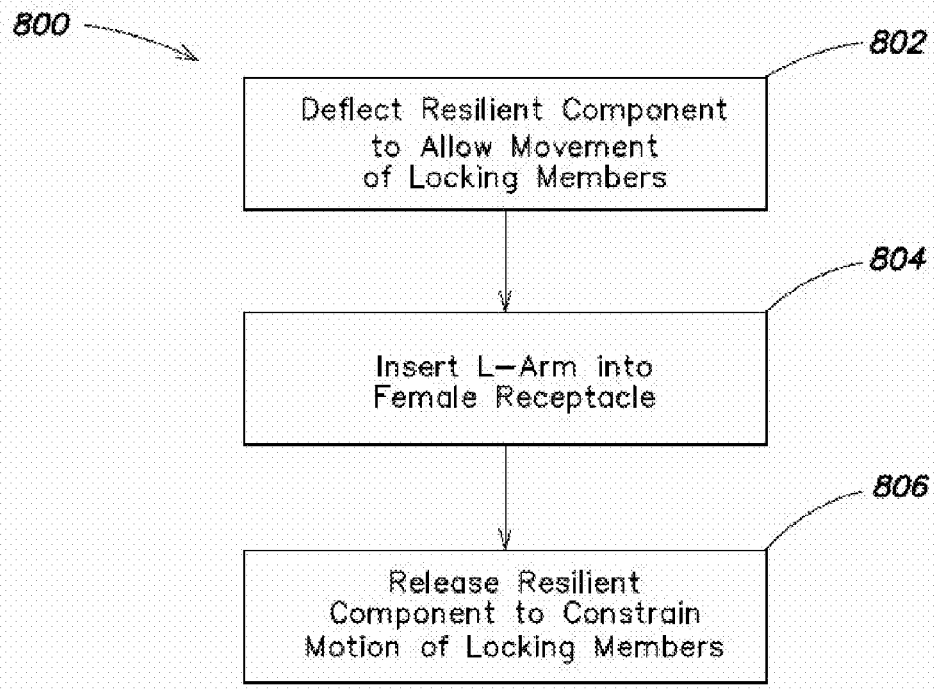
FIG. 8A is a flowchart of a method for connecting components of a drum kit using a connector assembly comprising a lock, such as the connector assembly of FIG. 2A, according to one non-limiting embodiment.
Figure 8B:
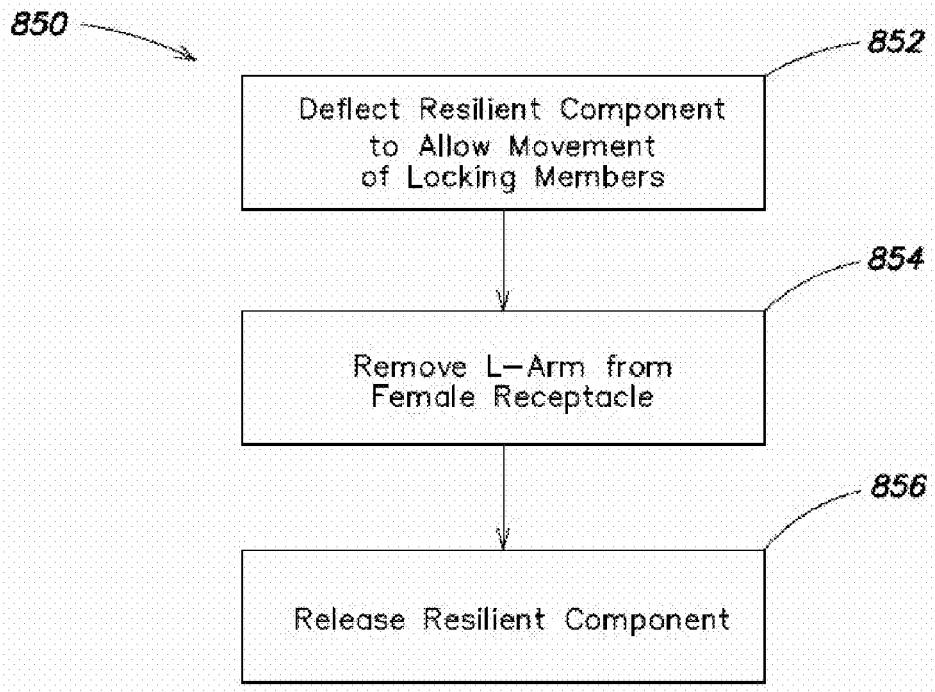
FIG. 8B is a flowchart of a method for disconnecting components of a drum kit which are connected by a connector assembly comprising a lock, such as the connector assembly of FIG. 2A, according to another non-limiting embodiment.

FIGS. 8A and 8B illustrate the manner of operation of a connector assembly according to one aspect of the present invention, such as connector assembly 200. FIG. 8A illustrates a method of engaging the lock, for example, when interconnecting components of a drum kit. FIG. 8B illustrates a method for releasing the lock, as may be used to disengage components of a drum kit.

Referring to FIG. 8A, the method 800 assumes that the L-arm is disengaged from the female receptacle to start. Thus, the method begins by deflecting the resilient component (e.g., coil spring 210) to allow movement of one or more locking members (e.g., SUS balls 226*a* and 226*b*), such as by deflecting the coil spring 210 to allow movement of the SUS balls 226*a* and 226*b* with respect to the cavity 220. Subsequently, an end of an L-arm (or pin) may be inserted into a cavity of the female receptacle, for example, by displacing the locking members. Subsequently, at 806 the resilient component is released, thereby constraining further motion of the locking members and engaging the lock.

FIG. 8B illustrates a method 850 for removing an L-arm engaged with a female receptacle in a locked state, according to one aspect of the present invention. The method assumes that the L-arm is in a locked state within the female receptacle, such as the female receptacle 202. The method begins at 852 by deflecting a resilient component to allow movement of locking members, such as SUS balls 226*a* and 226*b*. Subsequently, at 854, the L-arm is removed from the female receptacle, for example, removing L-arm 204 from the cavity 220. Subsequently, the resilient component is released at 856, leaving the L-arm and the female receptacle in a non-mating state.

It should be appreciated that the non-limiting examples illustrated thus far are provided primarily for purposes of illustration, and that various alternatives are possible. According to one aspect, components of a drum kit may be interconnected by a connector assembly comprising a resilient component which forces first and second connecting components into a mating relationship, but does not necessarily lock such components. For example, the L-arm may be disengaged by applying a suitable force, without the need to actuate a release mechanism. In such an embodiment, interconnection of components of a drum kit may be further simplified in that a single motion may be applied to engage the L-arm with the corresponding female receptacle, namely, pushing the L-arm into the female receptacle with sufficient force. Similarly, the components can be disconnected by applying a sufficient force to remove the L-arm from the mating arrangement.

As an example, referring to FIG. 3B, the connector assembly may be modified to provide a snap-fit type connection, and in particular a ball detent connection, rather than the illustrated ball lock connection. For example, the sleeve 212 and coil spring 210 may be removed. The base mount may be modified such that the SUS balls are biased inwardly (into the cavity 220), for example by springs. Inserting the L-arm into the cavity may apply a sufficient force to compress the biasing components outwardly, allowing the SUS balls to move outwardly to accommodate the L-arm. When the L-arm is inserted sufficiently far into the cavity, the biasing components may force the SUS balls (or other locking members) into the detents 218*b* and 218*c*, thus providing a secure connection that can be broken by simply apply a sufficient removal force to remove the L-arm from the cavity, again by compressing the biasing components outwardly to allow outward movement of the locking members to accommodate the width of the L-arm. Such a connection may therefore be a snap-type connection, allowing for engagement and disengagement of the L-arm with the female receptacle quickly and easily by simply inserting and removing the L-arm from the cavity 220, without the need to actuate a distinct release mechanism. Other variations are also possible.

Also, as mentioned with respect to FIG. 1, connector assemblies according to various aspects described herein may be used to connect components of a drum kit other than drums. For example, the female receptacle 126 and bass drum spur 124 may engage in substantially the same manner as that described for the L-arm 204 and female receptacle 202, and thus may provide a non-rotatable interconnection in some non-limiting embodiments.

Having thus described several aspects of the invention, it is to be appreciated various alterations, modifications, and improvements will readily occur to those skilled in the art. Such alterations, modification, and improvements are intended to be part of this disclosure, and are intended to be within the spirit and scope of the aspects of the invention. Accordingly, the foregoing description and drawings are by way of example only.

What is claimed is:

1. A drum kit, comprising:

a first kit component, the first kit component being a first drum;

a second kit component, the second kit component being a second drum or a cymbal; and a connector assembly interconnecting the first drum and the second kit component, the connector assembly configured to interconnect the second kit component to the first drum in a discrete, non-rotatable orientation relative to the first drum, wherein the connector assembly comprises a locking arm and a female receptacle configured to receive the locking arm, and wherein the female receptacle comprises a resilient component adapted to be actuated to bias one or more locking members into locking engagement with the connector arm.

2. The drum kit of claim 1, wherein the locking arm and the female receptacle form a ball lock connection.

3. The drum kit of claim 1, wherein the discrete, non-rotatable orientation is one of a plurality of discrete, non-rotatable orientations in which the connector assembly is configured to interconnect the first drum and the second kit component.

4. The drum kit of claim 1, wherein the first drum is a bass drum and the second kit component is a tom drum.

5. The drum kit of claim 1, wherein the connector arm comprises a detent formed therein and wherein the one or more locking members comprises a locking ball, and wherein the resilient component is adapted to be actuated to bias the locking ball into the detent.

6. The drum kit of claim 5, wherein the female receptacle further comprises a movable sleeve biased by the resilient component, and wherein the sleeve is configured to constrain motion of the locking ball by a variable amount in dependence on actuation of the resilient component.

7. A drum kit, comprising:

a first component, the first component being a first drum;

a second component; and a connector assembly comprising a lock configured to lock the second component into place relative to the first drum, wherein the connector assembly is a ball lock connector assembly, wherein the ball lock connector assembly comprises a first female receptacle mounted to the first drum, a second female receptacle mounted to the second component, and a connector arm having a first mating end and a second mating end, wherein the first female receptacle has a cavity configured to receive the first mating end of the connector arm and the second female receptacle has a cavity configured to receive the second mating end of the connector arm, and wherein the first female receptacle comprises a resilient component and a sleeve configured in combination to bias a locking member against the first mating end of the connector arm.

8. The drum kit of claim 7, wherein the cavity of the first female receptacle is shaped and configured to engage with the first mating end of the connector arm in a non-rotatable orientation.

9. The drum kit of claim 7, wherein the resilient component comprises a coil spring configured to bias the sleeve into a first position in which motion of the locking member is constrained by an inner surface of the sleeve to prevent insertion or removal of the first mating end from the first female receptacle.

10. The drum kit of claim 9, wherein the sleeve is movable, by compression of the coil spring, to a second position adapted to allow displacement of the locking member from the cavity of the first female receptacle by insertion of the first mating end into or removal of the first mating end from the cavity of the first female receptacle.

11. The drum kit of claim 7, wherein the connector arm is an L-arm.

12. The drum kit of claim 11, wherein the L arm includes a detent configured to receive the locking member.

13. The drum kit of claim 11, wherein the second component is a second drum.

14. A drum kit, comprising:

a first kit component comprising a first drum;

a second kit component; and a connector assembly comprising at least first and second connection components arranged to mate in a mating relationship and thereby secure the second kit component to the first kit component, wherein the connector assembly comprises at least one resilient component adapted to bias the first and second connection components into the mating relationship and configured to snap the first drum into a fixed orientation relative to the second kit component.

15. The drum kit of claim 14, wherein the second kit component is a second drum or a cymbal.

16. The drum kit of claim 15, wherein the first drum is a bass drum and the second component is a tom drum.

17. The drum kit of claim 15, wherein the second component is a cymbal.

18. The drum kit of claim 14, wherein the connector assembly is configured to form a ball detent connection.

19. The drum kit of claim 18, wherein the connector assembly comprises a first female receptacle mounted to the first drum and a connector arm having at least one detent formed therein, wherein the first female receptacle is configured to engage the at least one detent of the connector arm.

20. The drum kit of claim 19, wherein the connector arm has a first mating end and a second mating end, and wherein the at least one detent formed therein is a first detent on the first mating end, and wherein the connector arm further comprises a second detent on the second mating end, and wherein the connector assembly further comprises a second female receptacle mounted to the second kit component of the drum kit and configured to engage the second detent of the second mating end of the connector arm.

* * * * *

UNITED STATES PATENT AND TRADEMARK OFFICE

CERTIFICATE OF CORRECTION

PATENT NO. : 7,960,632 B2
APPLICATION NO. : 12/618307
DATED : June 14, 2011
INVENTOR(S) : Mark Izen et al.

It is certified that error appears in the above-identified patent and that said Letters Patent is hereby corrected as shown below:

At column 12, claim 16, line 47, add the word "kit" after the word "second".

At column 12, claim 17, line 48, add the word "kit" after the word "second".

Signed and Sealed this
Twenty-third Day of October, 2012

David J. Kappos

David J. Kappos
*Director of the United States Patent and Trademark Office*